US009091110B2

(12) United States Patent
Pawloski et al.

(10) Patent No.: US 9,091,110 B2
(45) Date of Patent: Jul. 28, 2015

(54) POWER SLIDING WINDOW ASSEMBLY WITH A STOPPER

(75) Inventors: Jamie Beth Pawloski, Canton, MI (US); Todd Michael Bello, Canton, MI (US); Jay L. Sackett, Ann Arbor, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 1202 days.

(21) Appl. No.: 12/425,864

(22) Filed: Apr. 17, 2009

(65) Prior Publication Data

US 2010/0263290 A1 Oct. 21, 2010

(51) Int. Cl.
*E05F 15/635* (2015.01)

(52) U.S. Cl.
CPC ..... *E05F 15/635* (2015.01); *E05Y 2201/224* (2013.01); *E05Y 2201/684* (2013.01); *E05Y 2600/46* (2013.01); *E05Y 2900/55* (2013.01)

(58) Field of Classification Search
USPC ..... 49/331, 332, 347, 349, 352, 360, 139, 49/140, 118, 380, 407, 413, 453, 454, 456, 49/455, 457; 16/82–86 B
IPC ..... B60J 1/1853; E05F 15/635; E05Y 2600/46, 2201/684
See application file for complete search history.

(56) References Cited

U.S. PATENT DOCUMENTS 1,051,508 A * 1/1913 Miller ..... 16/86 A
2,638,620 A * 5/1953 Civitelli ..... 16/375
3,333,363 A 8/1967 Garvey
3,835,790 A * 9/1974 Schwarz et al. ..... 105/285
5,233,724 A 8/1993 Lei tert et al.
5,718,083 A 2/1998 Dowdell, II
5,724,769 A 3/1998 Cripe et al.
5,799,449 A 9/1998 Lyons et al.
6,125,585 A * 10/2000 Koneval et al. ..... 49/349
2004/0134131 A1* 7/2004 Galer ..... 49/413
2005/0044799 A1* 3/2005 Kinross et al. ..... 49/413
2005/0066787 A1* 3/2005 Mori et al. ..... 83/452

FOREIGN PATENT DOCUMENTS

EP 1028214 A2 * 8/2000
JP 2001207725 A * 8/2001

* cited by examiner

*Primary Examiner* — Gregory Strimbu

(74) *Attorney, Agent, or Firm* — Gifford, Krass, Sprinkle, Anderson & Citkowski, P.C.

(57) ABSTRACT

A power sliding window assembly for a motor vehicle. The assembly can include a back window casing with a first window pane and a second window pane fixedly attached to the casing. A generally U-shaped guide rail can be at least partially encased within the window casing and be adjacent to the first window pane and the second window pane. A third window pane can have a portion fixedly attached to a glass carrier and the glass carrier can be located at least partially within and slidably engaged with the generally U-shaped guide rail. Located at least partially within the generally U-shaped guide rail can be a first stopper and a second stopper with the first and second stoppers providing for desired placement of the third window pane when it is in a closed position and a fully open position.

19 Claims, 5 Drawing Sheets

POWER SLIDING WINDOW ASSEMBLY WITH A STOPPER

FIELD OF THE INVENTION

The present invention is related to a power sliding window and in particular to a power sliding window assembly that has a stopper.

BACKGROUND OF THE INVENTION

Some pickup trucks are known to have a sliding rear window pane that affords for a rear window that will open and provide access to the bed of the truck and/or allow air to enter the cab truck. In some instances, the sliding rear window pane can be powered such that it slides back and forth through the use of an electrical and/or mechanical device.

In most instances, such a sliding rear window will have a window casing with a first window pane located on the left side of the casing and a second window pane located on the right side of the casing. The first window pane and the second window pane are generally fixedly attached to the window casing and are spaced apart from each other with an opening therebetween. In addition, a slidable third window pane is typically located generally parallel to the first window pane and the second window pane and is operable to be moved from a closed position where it seals or blocks the opening between the first and second window panes and an open position where it uncovers or unblocks at least part of the opening between the first and second window panes.

When the third window pane slides from the open position to the closed position, and vice versa, a glass carrier fixedly attached to the window pane can come into contact with a stopper, the stopper ensuring that the window pane stops at a desired location. In addition, the contact between the glass carrier and the stopper can result in a clicking or tapping noise therebetween. Such a noise can be annoying to an operator and/or passenger of the motor vehicle and repeated contact between the glass carrier and the stopper can result in excessive wear and tear. As such, a power sliding window assembly having a stopper that provides reduced noise and withstands wear between itself and a glass carrier that is attached to the window pane would be desirable.

SUMMARY OF THE INVENTION

A power sliding window assembly for a motor vehicle is provided. The assembly can include a window casing with a first window pane and a second window pane spaced apart from each other. A generally U-shaped guide rail can be at least partially encased within the window casing and be adjacent to the first window pane and the second window pane. A third window pane can be included and have a portion or edge fixedly attached to a glass carrier. The glass carrier can have a first end and a second end oppositely disposed therefrom. In addition, the glass carrier can be located at least partially within and slidably engaged with the generally U-shaped guide rail. In this manner, the third window pane can slide within and/or along the generally U-shaped guide rail.

A window pane sliding system can also be included, the window pane sliding system having a first engagement member attached to the first end of the glass carrier and a second engagement member attached to the second end of the glass carrier. In some instances, the first and/or second engagement members can be a cable, wire, cord, chain and the like. The window pane sliding system can be operable to slide the third window pane between a closed position and an open position by alternately pulling and/or pushing on the first engagement member and the second engagement member.

Located at least partially within the generally U-shaped guide rail adjacent to the first end of the glass carrier can be a first stopper. A second stopper can be located at least partially within the generally U-shaped guide rail adjacent to the second end of the glass carrier. The first stopper and the second stopper can be rigidly attached to the generally U-shaped guide rail and located such that the third window pane comes into contact with one of the stoppers when it slides into the closed position and comes into contact with the other stopper when it slides into the open position.

The first and second stoppers can each have a top surface and a bottom surface with a pair of oppositely disposed end surfaces extending therebetween. The first and second stoppers can also each have a crown-shaped cushion that is attached to one of the oppositely disposed end surfaces such that it faces the third window pane. The crown-shaped cushion is operable to compress when an end of the glass carrier is placed in contact therewith a predetermined amount of force. In some instances, the first stopper and the second stopper can each have a pair of oppositely disposed crown-shaped cushions, each of the crown-shaped cushions being attached to one of the oppositely disposed end surfaces of the stoppers.

The crown-shaped cushions can have a stick-resistant textured surface that reduces adhesion between the crown-shaped cushion and the glass carrier end that can be in contact therewith. Each of the pair of oppositely disposed crown-shaped cushions can also have at least one mechanical interlock tab that can mechanically interlock the crown-shaped cushion with the end surface of the stopper that the cushion is attached to. In addition, each of the pair of oppositely disposed crown-shaped cushions can be fixedly attached to each other. For example, a connecting strap can extend from one of the crown-shaped cushions and be attached to the oppositely disposed crown-shaped cushion.

DETAILED DESCRIPTION OF THE INVENTION

The present invention discloses a power sliding window assembly for a motor vehicle. In some instances, the power sliding window assembly can be a rear window assembly for a pickup truck and the like. As such, the assembly has utility as a component for a motor vehicle.

The power sliding window assembly includes a stopper that is located at least partially within a generally U-shaped guide rail. In some instances, the generally U-shaped guide rail can be at least partially encased within a polymeric casing, however this is not required. In some instances, two stoppers can be included such that the position of a sliding window pane is desirably controlled when it is in an open position and/or a closed position.

The stopper or each of the two stoppers can include a crown-shaped cushion that can come into contact with a glass carrier attached to the sliding window pane when the sliding window pane is in the open and/or closed position. The crown-shaped cushion is compressible and provides for a reduction in noise when the glass carrier comes into contact therewith.

The sliding window pane can be moved from the open position to the closed position, and vice versa, by a window pane sliding system that can slide the window pane using an electrical and/or mechanical controlled device. In some instances, an engagement member can push or pull upon the sliding window pane until the glass carrier reaches or contacts one of the stoppers and the crown-shaped cushion is compressed a predetermined amount. It is appreciated that the crown-shaped cushion has such a shape such that it does not lose its desired function after prolonged use. In addition, the crown-shaped cushion can have a textured surface that is anti-stick, stick-resistant and the like. In this manner, adhesion between the crown-shaped cushion and the glass carrier attached to the sliding window pane is reduced.

When the glass carrier attached to the sliding window pane comes into contact with the crown-shaped cushion, any noise that is typically produced by the contact between these two components can be reduced. In addition, the compression of the crown-shaped cushion affords for decreased wear and tear of the stopper and/or sliding window pane/glass carrier during repeated use of the assembly.

Figure 1:
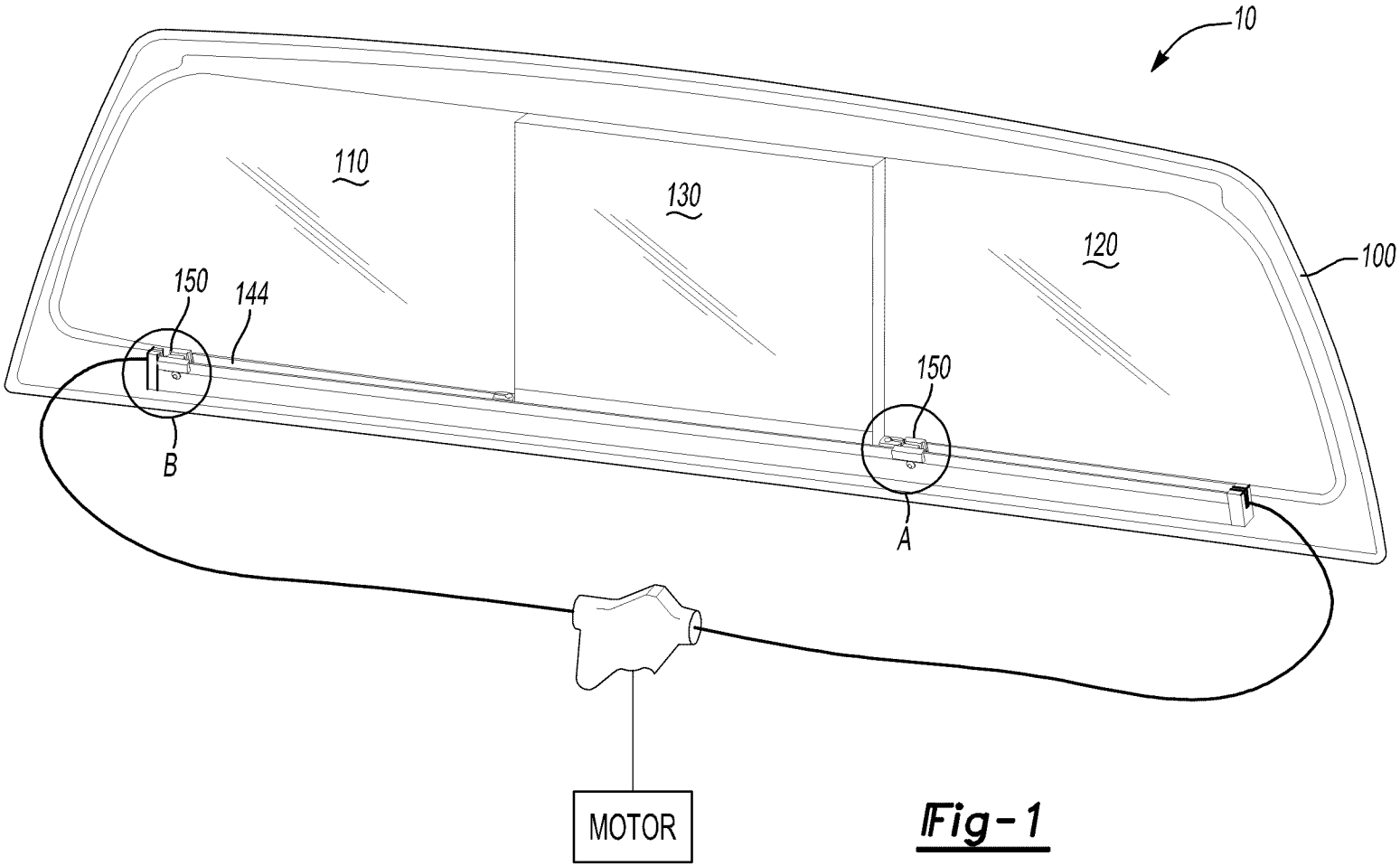
FIG. 1 is a perspective view of a power sliding window assembly.
Figure 2:
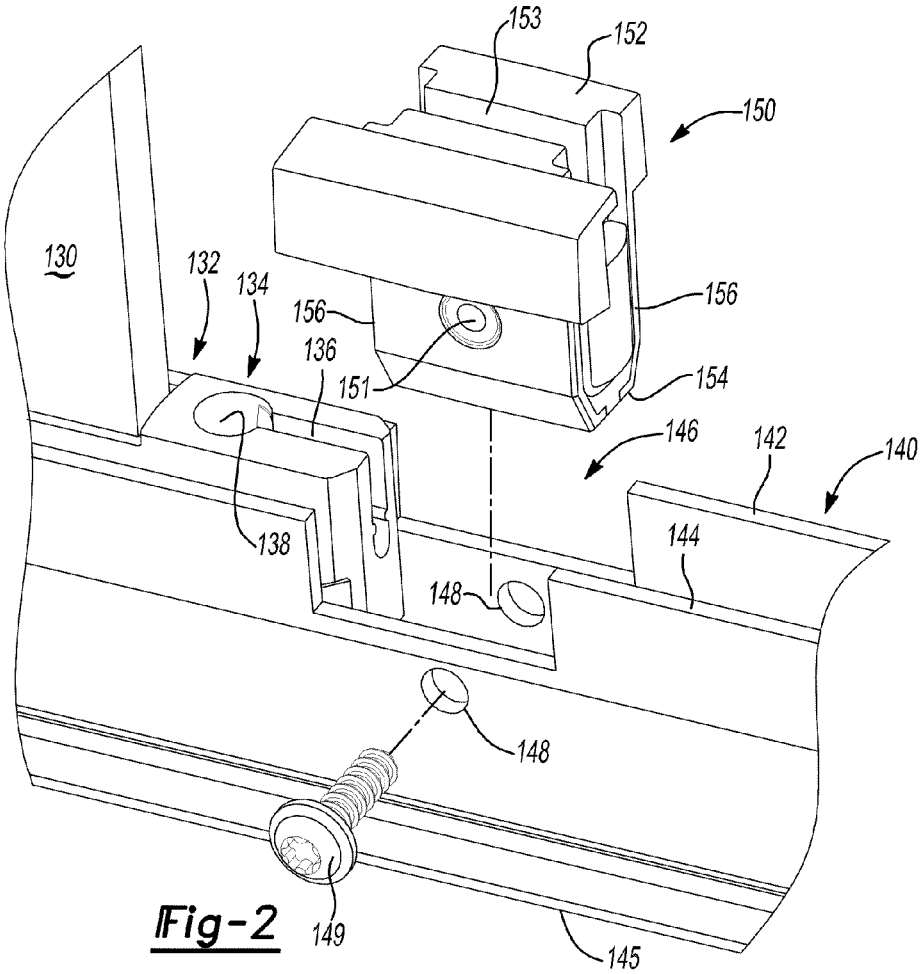
FIG. 2 is an exploded perspective view of a stopper, a generally U-shaped guide rail and a portion of a third window pane attached to a glass carrier.
Figure 3:
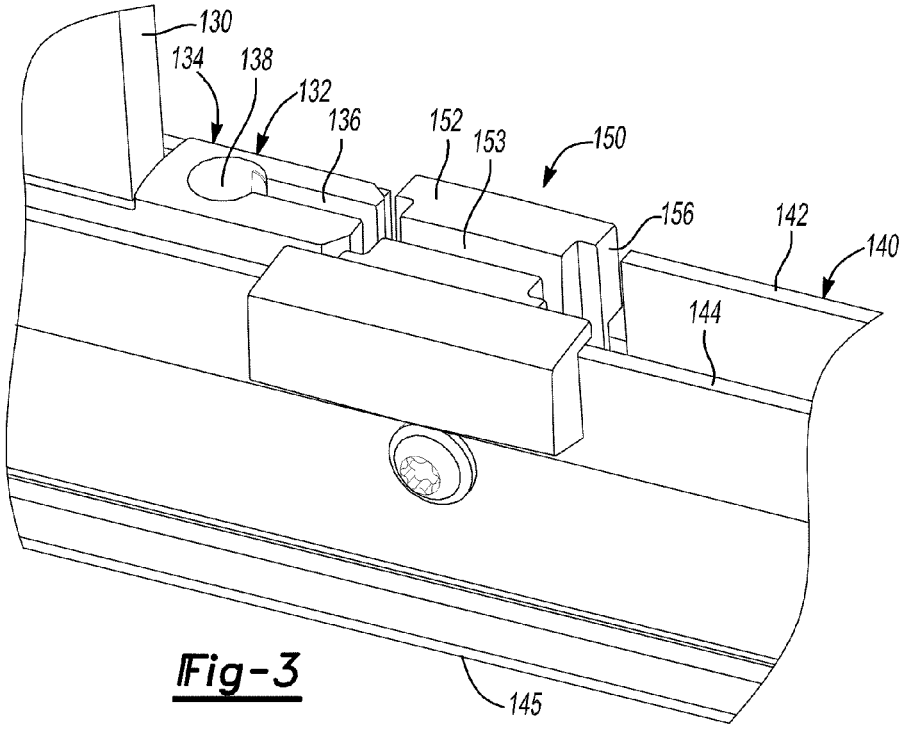
FIG. 3 is a perspective view of the embodiment shown in FIG. 2 with the stopper attached to the generally U-shaped guide rail.

Turning now to FIG. 1, a power sliding window assembly is shown generally at reference numeral 10. The assembly 10 can include a casing 100 with a first window pane 110 and a second window pane 120 fixedly attached thereto and spaced apart from each other. A third window pane 130 can also be included, the third window pane 130 being slidable with respect to the first window pane 110 and the second window pane 120. The third window pane 130 can also have a glass carrier 132 attached thereto as shown in FIGS. 2 and 3. A stopper 150 according to an embodiment of the power sliding back window assembly 10 is also shown.

Turning now to FIGS. 2 and 3, the stopper 150 can have a top surface 152 and a bottom surface 154. Extending between the top surface 152 and the bottom surface 154 can be a pair of oppositely disposed end surfaces 156. A slot 153 can extend between the oppositely disposed end surfaces 156 in a downwardly direction from the top surface 152. It is appreciated that the slot 153 extends downwardly through the top surface 152 and can have a width that affords for an engagement member to slide therethrough.

The glass carrier 132 attached to the third window pane 130 can have a first end 134, the first end 134 having a slot 136 and a counter-bore 138. It is appreciated that the slot 136 and/or counter-bore 138 can extend in a downwardly direction a predetermined distance that is generally equivalent with a depth of the slot 153 of the stopper 150. It is further appreciated that the glass carrier 132 can have an oppositely disposed second end (not shown) that may or may not have the same general shape, features, functions, etc., as the first end 134. In the figures, the second end is not shown but is known by those skilled in the art to be a mirror image of the first end 134.

The third window pane 130 and/or the glass carrier 132 can be at least partially located within and slidably engageable with a generally U-shaped guide rail 140. The guide rail 140 can have a first wall 142, a second wall 144 and a bottom wall 145 extending between the first wall 142 and second wall 144. It is appreciated that the first wall 142 and second wall 144 can be oppositely disposed and generally parallel to each other. In addition, the guide rail 140 with the first wall 142 and second wall 144 can have one or more notches 146 that extend transversely through each wall and one or more apertures 148 longitudinally spaced apart from each other that afford for the stopper 150 to be placed at least partially within the guide rail 140 and within each of the one or more notches 146. The stopper 150 can have an aperture 151 that can be in alignment with the apertures 148 in the guide rail 140, thereby affording for a fastener 149 to be inserted through at least one of the apertures 148 and the aperture 151 in order to rigidly attach the stopper 150 to the guide rail 140.

Figure 4A:
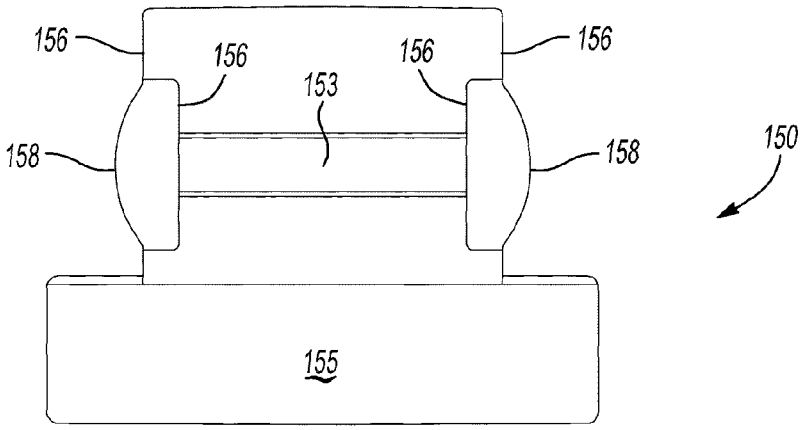
FIG. 4A is a top view of the stopper shown in FIGS. 2 and 3.
Figure 4B:
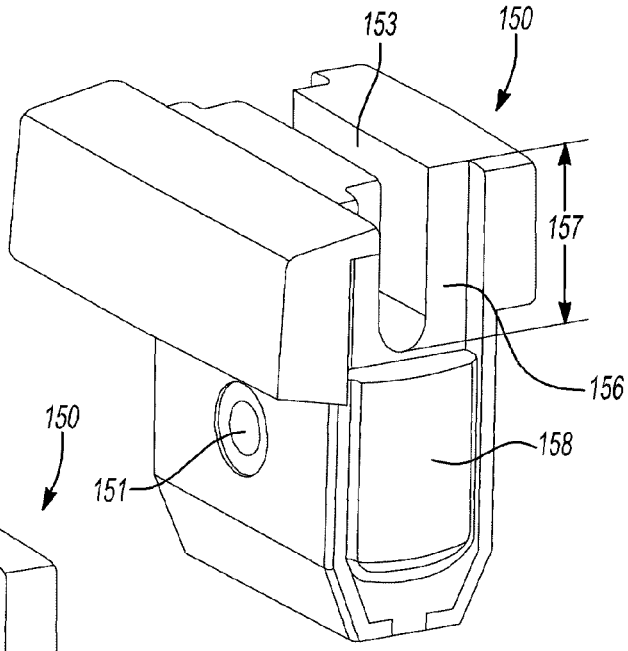
FIG. 4B is a perspective view of the stopper shown in FIGS. 2 and 3.
Figure 4C:
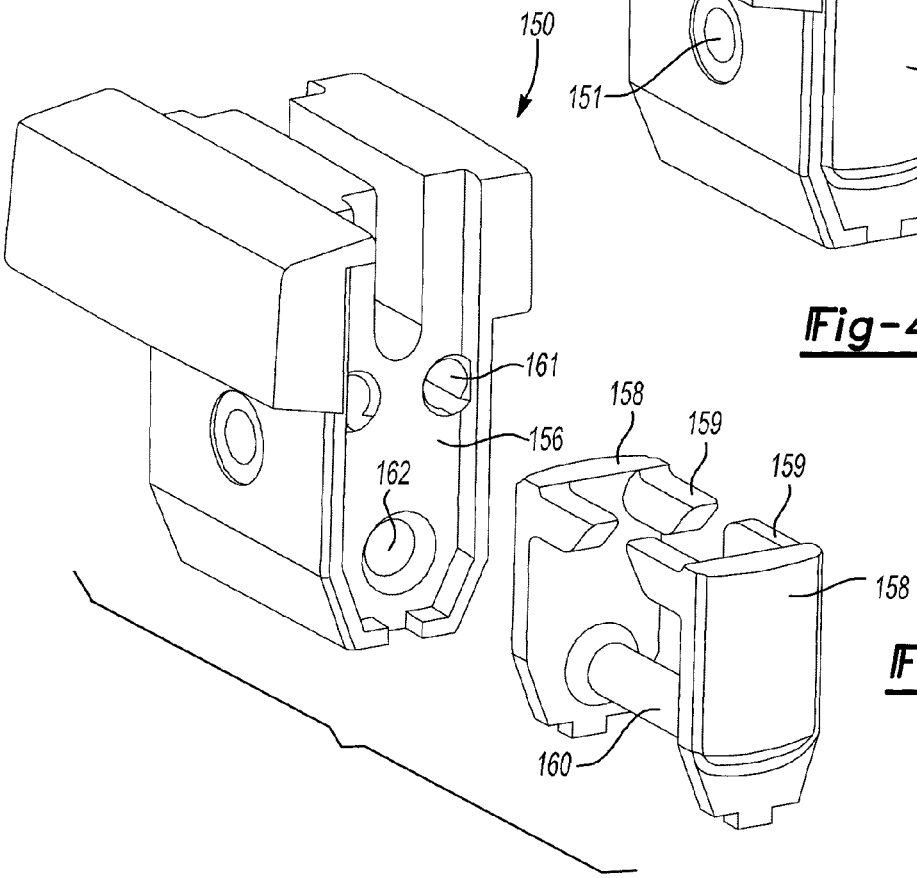
FIG. 4C is a perspective view of the stopper shown in FIG. 4B illustrating interlocking tabs and a connecting strap of a pair of crown-shaped cushions.

Looking now at FIGS. 4A-4C, different views of the stopper 150 are shown. In particular, FIG. 4A shows a top view of the stopper 150 and illustrates a pair of oppositely disposed crown-shaped cushions 158 attached to the oppositely disposed end surfaces 156. As shown in these figures, the end surfaces 156 can have a step region where the crown-shaped cushions are located. In addition, the slot 153 extending from one of the end surfaces 156 to the other end surface 156 is shown. A flange 155 can also be included as part of the stopper 150, the flange 155 providing structural support and ensuring proper placement of the stopper 150 with respect to the guide rail 140. It is appreciated from the FIGS. 4A-4C that the crown-shaped cushions 158 are arcuate- and dome-shaped with a center portion extending outwardly from a pair of oppositely disposed side regions or edges.

FIG. 4B illustrates one of the end surfaces 156 of the stopper 150. The crown-shaped cushions 158 can be located below the slot 153, slot 153 having a predetermined depth 157 which can be generally equal to a depth of the slot 136 of the first end 134 of the glass carrier 132. In this manner, an engagement member passing through the slot 153 of the stopper 150 can also pass through the slot 136 of the glass carrier 132.

Looking now specifically at FIG. 4C, an exploded view of the pair of crown-shaped cushions 158 is shown relative to the stopper 150. The pair of crown-shaped cushions 158 can each have at least one mechanical interlocking tab 159 that can mechanically interlock with a counter bore aperture 161 of the stopper 150. In addition, the stopper 150 can have a connecting strap aperture 162 that extends from one end surface 156 to the other end surface 156 and thereby affords for a connecting strap 160 to extend therethrough. The connecting strap 160 can be attached to and extend from one of the crown-shaped cushions 158 to the other oppositely disposed crown-shaped cushion 158. In this manner, the pair of crown-shaped cushions 158 can be attached to each other and be rigidly attached to the stopper 150. As such, the movement or displacement of the crown-shaped cushion 158 is minimized during continued use of the power sliding back window assembly 10.

Figure 5:
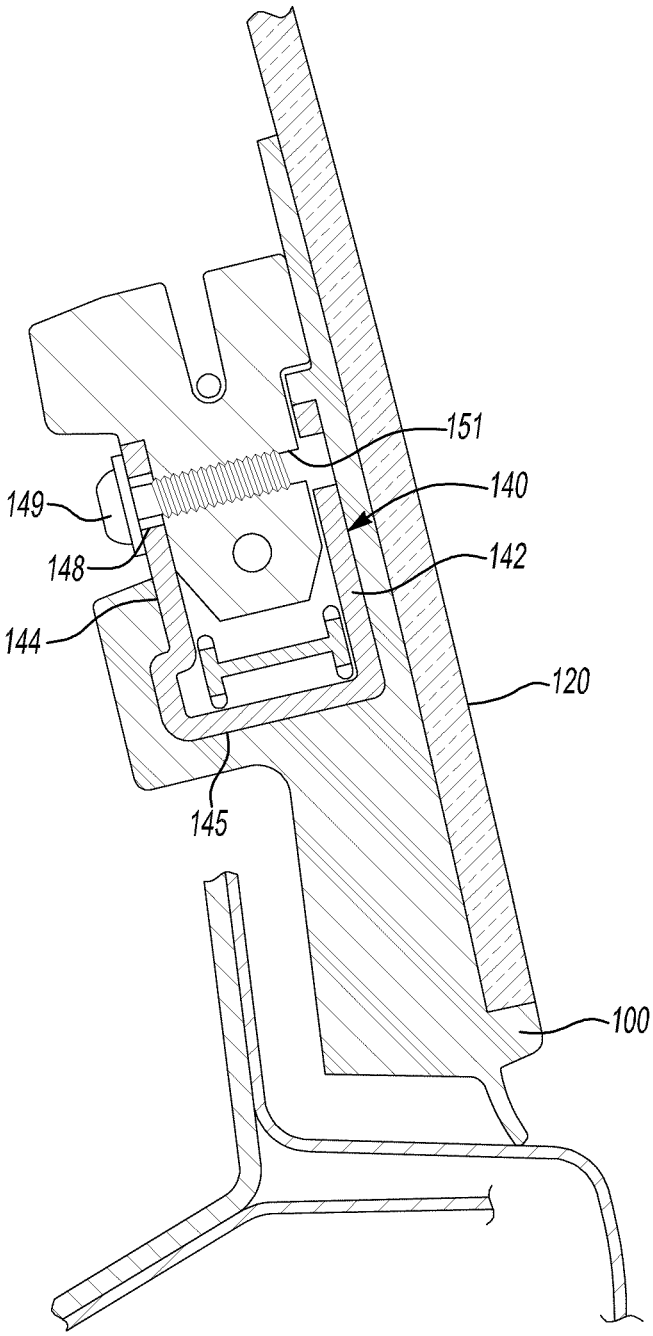
FIG. 5 is a side cross-sectional view of the stopper shown in FIG. 3.

FIG. 5 illustrates a side cross-sectional view of the stopper 150 attached to the guide rail 140. As shown in this figure, the fastener 149 can be in the form of a threaded fastener, for example a screw, that extends through one of the apertures 148 that is within the first wall 142 or second wall 144 of the guide rail 140 and in the aperture 151 of the stopper 150. FIG. 5 also illustrates that the casing 100 can at least partially encapsulate the guide rail 140 and the second pane 120 can also be attached thereto. In addition, FIG. 5 illustrates guide rail 140 can be adjacent to, but spaced apart a predetermined distance from, the first window pane 110 and/or second window pane 120 and have an inner guide rail 140 that can assist in the sliding of the third window pane 130.

Figure 6:
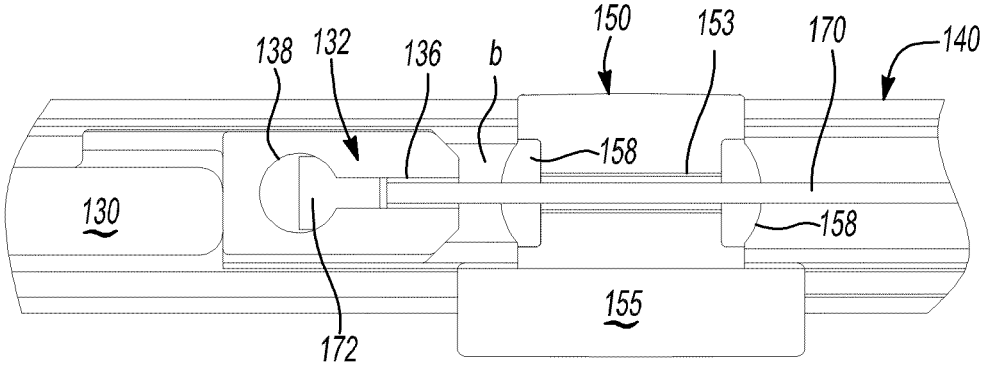
FIG. 6 is a top view of the stopper shown in FIG. 3 spaced apart from the glass carrier.

FIG. 6 illustrates a top view of the sliding third window pane 130 with the attached glass carrier 132 proximate to the stopper 150 but with a space b therebetween. As such, the crown-shaped cushion 158 has a full uncompressed shape/form. An engagement member 170, illustratively in the form of a cable, can extend through the slot 153 and the slot 136. The engagement member 170 can have an end 172 that is dimensioned to fit at least partially within the counter-bore 138 but can not fit or slide through the slot 136. In this manner, the engagement member 170 can be attached to the glass carrier 132, can be used to pull and/or push upon the glass carrier 132, and thereby be used to move the window pane 130 between an open position and a closed position.

Figure 7:
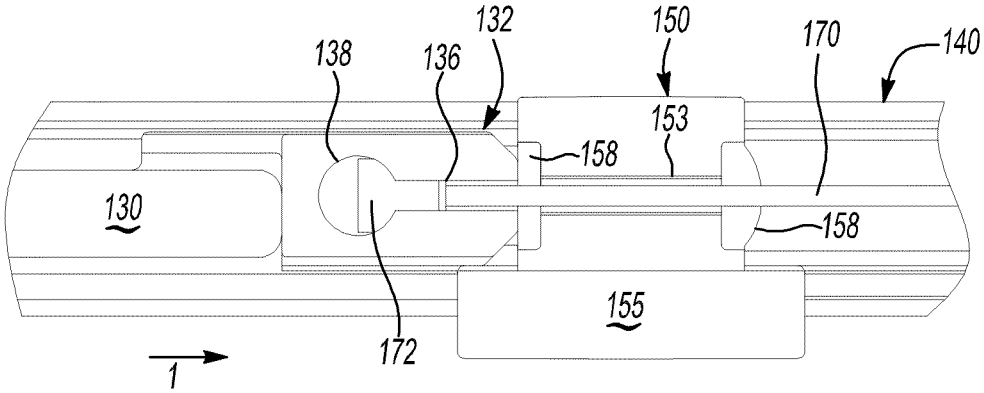
FIG. 7 is a top view of the stopper shown in FIG. 6 in contact with the glass carrier.

As shown in FIG. 7, movement of the window pane 130 in a direction 1 towards the stopper 150 can bring the glass carrier 132 into contact therewith. Assuming a predetermined amount of force has been applied against the stopper 150, the crown-shaped cushion 158 that is adjacent to the glass carrier 132 can be compressed as shown. The compressing of the crown-shaped cushion 158 can reduce any noise that results from contact between the glass carrier 132 and the stopper 150. In addition, the crown-shaped cushion 158 can have a textured surface that affords for a reduction of any sticking or adhesion between the cushion 158 and the glass carrier 132. In some instances, the textured surface on the cushion 158 is provided by a tool surface being etched with a textured surface and the tool textured surface being in contact with the surface of the cushion 158 when it is formed. For example, the surface of a molding cavity in which the cushion 158 is formed can be etched with a textured surface, a general mirror image of the molding cavity surface being produced on the cushion surface when it is produced. In this manner, any sticking or adhesion between the crown-shaped cushion 158 and an end of the glass carrier 132 can be reduced and/or eliminated.

It is appreciated that more than one stopper 150 can be located at least partially within the guide rail 140. For example and for illustrative purposes only, a first stopper 150 can be located on one side of the sliding window pane 130 and a second stopper 150 can be located on an opposite side of the window pane 130 as shown in FIG. 1. In this manner, one of the stoppers can provide for desired placement of the third window pane 130 when it is in the closed position and one of the stoppers can provide desired placement of the third window pane 130 when it is in the fully open position. For example and for illustrative purposes only, FIG. 1 shows where a first stopper 150 can be located at location A and a second stopper 150 can be located at location B. The stopper 150 located at location A can ensure that the sliding window pane 130 is at a desirable location when it is placed in the fully closed position. Likewise, the stopper 150 at the location B can ensure that the sliding window pane 130 is at a desirable location when it is in a fully open position.

The casing 100 can be made from any polymer known to those skilled in the art, illustratively including a polyvinyl chloride (PVC) resin. In addition, the stopper 150 can be made from polymers, plastics, etc., for example a glass-filled nylon. The crown-shaped cushion 158 can be made from an elastomer, for example a polyether based thermoplastic polyurethane.

The foregoing drawings, discussion and description are illustrative of specific embodiments of the present invention, but they are not meant to be limitations upon the practice thereof. Numerous modifications and variations of the invention will be readily apparent to those of skill in the art in view of the teaching presented herein. It is the following claims, including all equivalents, which define the scope of the invention.

We claim:

1. A sliding window assembly for a motor vehicle, said assembly comprising:

a generally U-shaped guide rail having a pair of oppositely disposed and generally parallel side walls, each of said pair of side walls having an upper edge;

a window pane slidably engaged with said generally U-shaped guide rail;

a first stopper attached to and located at least partially within said generally U-shaped guide rail on one side of said window pane and a second stopper attached to and located at least partially within said generally U-shaped guide rail on a second side of said window pane;

said first and second stoppers each having a first arcuate-shaped cushion facing said window pane, whereby each of said arcuate-shaped cushions is operable to compress when a force is exerted thereon by said window pane, each of said first and second stoppers also has a top surface and a cable slot extending downwardly through said top surface;

said generally U-shaped guide rail having a first notch in and extending transversely through said pair of side walls, and a second notch in and extending transversely through said pair of side walls said second notch spaced apart from said first notch along a longitudinal axis of said guide rail and said first stopper located at least partially within said first notch and said second stopper located at least partially within said second notch, said first stopper and said second stopper extending above said upper edges of said generally U-shaped guide rail.

2. The assembly of claim 1, further comprising a window casing, said generally U-shaped guide rail fixedly attached to said window casing.

3. The assembly of claim 2, wherein said generally U-shaped guide rail is at least partially encased within said window casing.

4. The assembly of claim 2, wherein said window casing is made from a polyvinyl chloride resin.

5. The assembly of claim 2, wherein each of said first and second stoppers has an end surface, each of said arcuate-shaped cushions is attached to a respective one of said end surfaces below a respective one of said cable slots.

6. The assembly of claim 1, further comprising a fastener extending through said first stopper and at least one of said generally parallel side walls.

7. The assembly of claim 1, wherein each of said arcuate-shaped cushions has at least one mechanical interlock tab, whereby each of said at least one mechanical interlock tabs is mechanically interlocked with a respective one of said first and second stoppers.

8. The assembly of claim 1, wherein each of said arcuate-shaped cushions has a textured surface, each of said textured surfaces facing said window pane and reducing adhesion between said surface and a glass carrier attached to said window pane when said glass carrier is moved away from a position in contact with said surface.

9. The assembly of claim 1, wherein each of said first and second stoppers has a second arcuate-shaped cushion disposed on an end of said stopper opposite said first arcuate-shaped cushion.

10. The assembly of claim 9, wherein each of said arcuate-shaped cushions has at least one mechanical interlock tab mechanically interlocking said arcuate-shaped cushion with a respective one of said stoppers.

11. The assembly of claim 9, wherein each of said first arcuate-shaped cushions has a textured surface, each of said textured surfaces facing said window pane and reducing adhesion between said surface and a glass carrier attached to said window pane when said glass carrier is moved away from a position in contact with said surface.

12. The assembly of claim 9, wherein for each of said first and second stoppers said first and second arcuate-shaped cushions are fixedly attached to each other by a connecting strap extending through said stopper.

13. The assembly of claim 12, wherein each of said stoppers has a connection strap aperture extending therethrough.

14. A power sliding window assembly for a motor vehicle, said assembly comprising:

a window casing;

a generally U-shaped guide rail having a pair of oppositely disposed and generally parallel side walls and attached to said window casing, each of said pair of side walls having an upper edge;

a sliding window pane having a portion thereof fixedly attached to a glass carrier, said glass carrier having a first end and a second end, said glass carrier also located at least partially within and slidably engaged with said generally U-shaped guide rail;

a window pane sliding system having a first cable attached to said first end of said glass carrier and a second cable attached to said second end of said glass carrier, said window pane sliding system operable to slide said window pane along said guide rail by pulling on said first cable or said second cable;

a first stopper attached to and located at least partially within said generally U-shaped guide rail adjacent a first end of said guide rail and a second stopper attached to and located at least partially within a generally U-shaped guide rail adjacent said second end of said guide rail;

said generally U-shaped guide rail having a first notch in and extending transversely through said pair of side walls and a second notch in and extending transversely through said pair of side walls, said second notch spaced apart from said first notch along a longitudinal axis of said guide rail and said first stopper located at least partially within said first notch and said second stopper located at least partially within said second notch; and said first and second stoppers each having a first arcuate-shaped cushion attached thereto and facing said window pane, whereby each of said arcuate-shaped cushions is operable to compress when a force is exerted thereon by said glass carrier, each of said first and second stoppers also has a top surface and a cable slot extending downwardly through said top surface, said first stopper and said second stopper extending above said upper edges of said generally U-shaped guide rail.

15. The assembly of claim 14, wherein each of said first and second stoppers has a second arcuate-shaped cushion disposed on an end of said stopper opposite said first arcuate-shaped cushion oppositely disposed shaped cushions attached to one of a pair of oppositely disposed end surfaces of said first and second.

16. The assembly of claim 15, wherein for each of said first and second stoppers said first and second arcuate-shaped cushions are fixedly attached to each other by a connecting strap extending through said stopper.

17. The assembly of claim 16, wherein each of said stoppers has a connection strap aperture extending therethrough.

18. The assembly of claim 15, wherein each of said first arcuate-shaped cushions has a textured surface, each of said textured surfaces facing said glass carrier and reducing adhesion between said surface and said glass carrier when said glass carrier is moved away from a position in contact with said surface.

19. The assembly of claim 15, wherein each of said arcuate-shaped cushions has at least one mechanical interlock tab mechanically interlocking said arcuate-shaped cushion with a respective one of said stoppers.

* * * * *